US009570821B2

(12) United States Patent
Yamakami

(10) Patent No.: US 9,570,821 B2
(45) Date of Patent: Feb. 14, 2017

(54) CONNECTOR AND CONNECTOR UNIT

(71) Applicant: FUJITSU COMPONENT LIMITED, Tokyo (JP)

(72) Inventor: Tohru Yamakami, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 278 days.

(21) Appl. No.: 13/965,367

(22) Filed: Aug. 13, 2013

(65) Prior Publication Data

US 2014/0051300 A1 Feb. 20, 2014

(30) Foreign Application Priority Data

Aug. 16, 2012 (JP) ..... 2012-180640

(51) Int. Cl.
*H01R 12/51* (2011.01)
*H01R 12/53* (2011.01)

(52) U.S. Cl.
CPC ..... *H01R 12/515* (2013.01); *H01R 12/53* (2013.01)

(58) Field of Classification Search
CPC ..... H01R 12/515; H01R 12/53
USPC ..... 439/630, 631
See application file for complete search history.

(56) References Cited

U.S. PATENT DOCUMENTS 3,880,493 A * 4/1975 Lockhart, Jr. ..... 439/525
4,166,667 A * 9/1979 Griffin ..... 439/637
4,184,735 A * 1/1980 Ammon et al. ..... 439/637
4,780,603 A * 10/1988 Hamada ..... 235/492
4,789,352 A * 12/1988 Kreinberg et al. ..... 439/260
4,976,630 A * 12/1990 Schuder et al. ..... 439/260
5,144,586 A * 9/1992 Faraci ..... 365/226
5,667,408 A * 9/1997 Broschard et al. ..... 439/630
5,679,008 A * 10/1997 Takahashi ..... H01R 9/0515 439/497
6,027,345 A * 2/2000 McHugh et al. ..... 439/66
6,078,012 A * 6/2000 Suzuki et al. ..... 174/260
6,084,296 A * 7/2000 Colello et al. ..... 257/698
6,394,842 B1 5/2002 Sakurai et al.
6,948,949 B1 * 9/2005 Schwartz et al. ..... 439/76.1
6,951,467 B1 * 10/2005 Hansen ..... 439/82
7,632,151 B2 * 12/2009 Wang et al. ..... 439/630
8,061,608 B2 * 11/2011 Liao ..... H01R 13/6658 235/439
8,491,339 B2 * 7/2013 Matsumoto et al. ..... 439/630
8,684,751 B2 * 4/2014 Lo ..... 439/76.1
(Continued)

FOREIGN PATENT DOCUMENTS

JP 2001-076804 3/2001
JP 2007-157393 6/2007
(Continued)

*Primary Examiner* — Briggitte R Hammond
(74) *Attorney, Agent, or Firm* — IPUSA, PLLC

(57) ABSTRACT

A connector connectable to another connector includes a connector card including a first surface and a second surface, a cable pad provided on the first surface and configured to be connected to a cable core wire, a contact that is provided on the second surface and corresponds to the cable pad, wherein the contact is positioned across the connector card from the corresponding cable pad and is configured to come into contact with the other connector, and an electrically conductive part provided through the connector card, wherein the conductive part electrically connects the cable pad and the corresponding contact.

13 Claims, 8 Drawing Sheets

(56) References Cited

U.S. PATENT DOCUMENTS

| | | | | |
|---|---|---|---|---|
| 2001/0010984 | A1* | 8/2001 | Bricaud et al. | 439/630 |
| 2006/0172572 | A1* | 8/2006 | Matsukawa et al. | 439/159 |
| 2007/0140643 | A1 | 6/2007 | Daikuhara et al. | |
| 2008/0305692 | A1* | 12/2008 | Little et al. | 439/676 |
| 2011/0195592 | A1* | 8/2011 | McGrath et al. | 439/345 |
| 2011/0318967 | A1* | 12/2011 | Yoshida | G06K 7/003 439/629 |
| 2013/0264107 | A1* | 10/2013 | Meyers | 174/268 |

FOREIGN PATENT DOCUMENTS

| | | |
|---|---|---|
| JP | 2008-091363 | 4/2008 |
| JP | 2009-277372 | 11/2009 |
| JP | 2010-108848 | 5/2010 |

* cited by examiner

CONNECTOR AND CONNECTOR UNIT

CROSS-REFERENCE TO RELATED APPLICATION

The present application is based upon and claims the benefit of priority of Japanese Patent Application No. 2012-180640, filed on Aug. 16, 2012, the entire contents of which are incorporated herein by reference.

BACKGROUND OF THE INVENTION

1. Field of the Invention

The present invention relates to a connector.

2. Description of the Related Art

In recent years, the speed of transmission paths has increased in order to handle a large volume of communications traffic in video communications and the like. Various connectors that connect a cable, which is adaptive to the increase in the data transfer rate, to a printed circuit board have been proposed.

For example, Japanese Laid-Open Patent Application No. 2001-76804 discloses a cable connector intended for improvement in electromagnetic compatibility.

Furthermore, Japanese Laid-Open Patent Application No. 2007-157393 discloses a cable connector that is adaptable to an increase in the data transfer rate.

SUMMARY OF THE INVENTION

According to an aspect of the present invention, a connector connectable to another connector includes a connector card including a first surface and a second surface, a cable pad provided on the first surface and configured to be connected to a cable core wire, a contact that is provided on the second surface and corresponds to the cable pad, wherein the contact is positioned across the connector card from the corresponding cable pad and is configured to come into contact with the other connector, and an electrically conductive part provided through the connector card, wherein the conductive part electrically connects the cable pad and the corresponding contact.

According to an aspect of the present invention, a connector connectable to another connector includes a jack contact configured to come into contact with a corresponding contact of the other connector.

According to an aspect of the present invention, a connector unit includes a first connector and a second connector connectable to the first connector. The first connector includes a connector card including a first surface and a second surface, a cable pad provided on the first surface and configured to be connected to a cable core wire, a contact that is provided on the second surface and corresponds to the cable pad, wherein the contact is positioned across the connector card from the corresponding cable pad and is configured to come into contact with the second connector, and an electrically conductive part provided through the connector card, wherein the conductive part electrically connects the cable pad and the corresponding contact. The second connector includes a jack contact configured to come into contact with the contact of the first connector and a jack contact holding member configured to hold the jack contact in accordance with an arrangement of the contact provided on the second surface of the connector card of the first connector.

DESCRIPTION OF THE EMBODIMENTS

Various connectors have been proposed to accommodate an increase in the data transfer rate. When the data transfer rate increases to, for example, 10 Gb (gigabits) or more, however, noise or transmission loss may become a problem.

In the conventional connector described in Japanese Laid-Open Patent Application No. 2001-76804 mentioned above, the core wires of a cable and the contact pieces of the connector are connected by the electrically conductive members of signal contacts. Noise or transmission loss may occur at high frequencies depending on the impedance of these electrically conductive members.

In Japanese Laid-Open Patent Application No. 2007-157393, the insulation-coated signal electric wires of a cable are soldered to wire soldering pads and are connected to a card edge connection part with interconnection patterns. Therefore, noise or transmission loss may occur at high frequencies in the interconnection patterns.

Furthermore, the impedance of an interconnection pattern formed on a circuit board may be reduced by, for example, reducing the dielectric constant by using a material such as FR4 (Flame Retardant Type 4) for the circuit board. This method, however, has the problem of a higher cost of the circuit board.

One or more embodiments of the present invention are described below with reference to the accompanying drawings.

Figure 1:
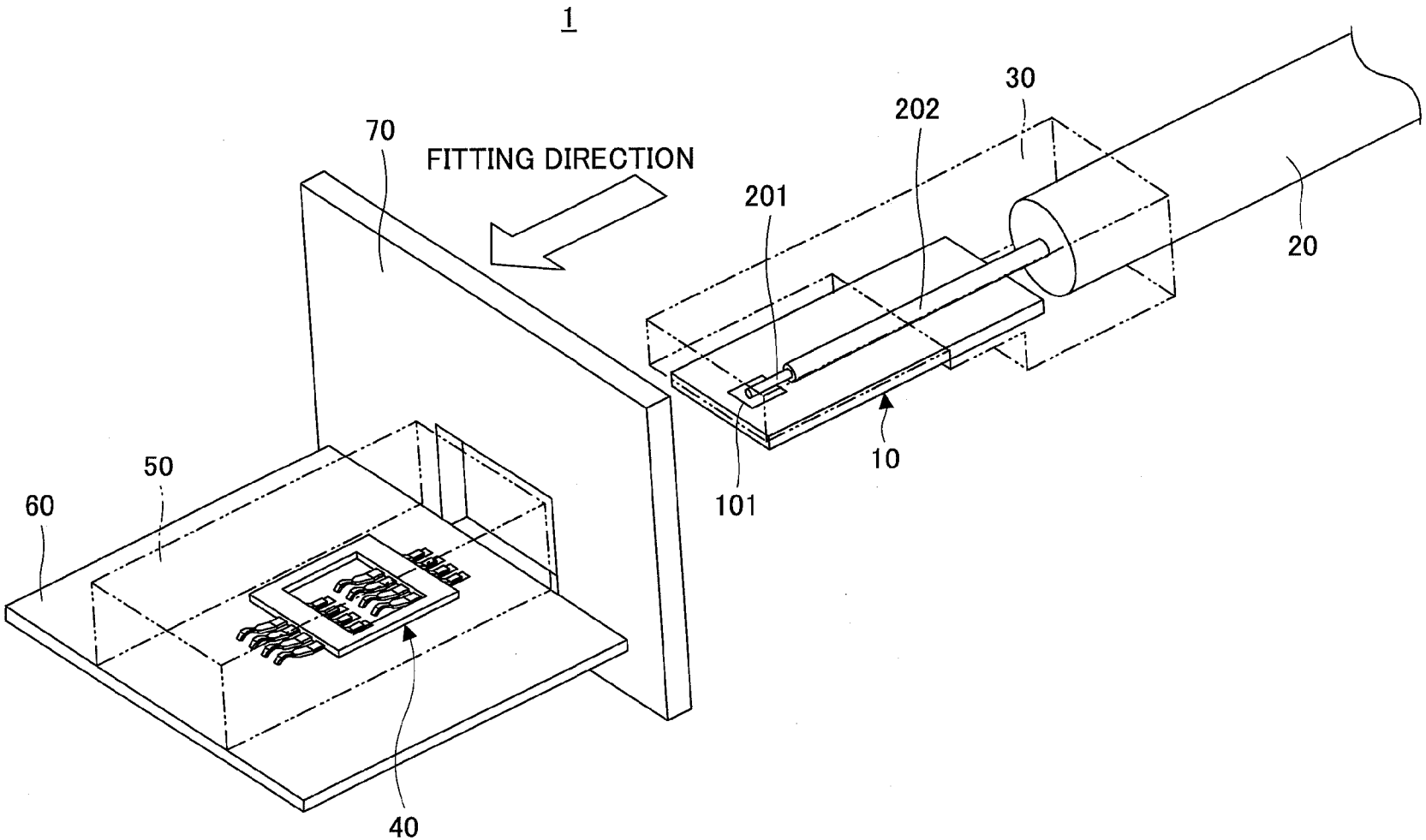
FIG. 1 is a schematic perspective view of a cable connector system before fitting according to an embodiment.

FIG. 1 is a partially-transparent perspective view of a cable connector system according to an embodiment, before fitting a cable-side connector housing and a board-side connector housing. In FIG. 1, a connector system 1 includes a cable-side connector 10, a cable 20, a cable-side connector housing 30, a board-side connector 40, and a board-side connector housing 50. The connector system 1 connects a circuit board 60 attached to an enclosure 70 (partially illustrated in FIG. 1) and the cable 20.

Figure 2:
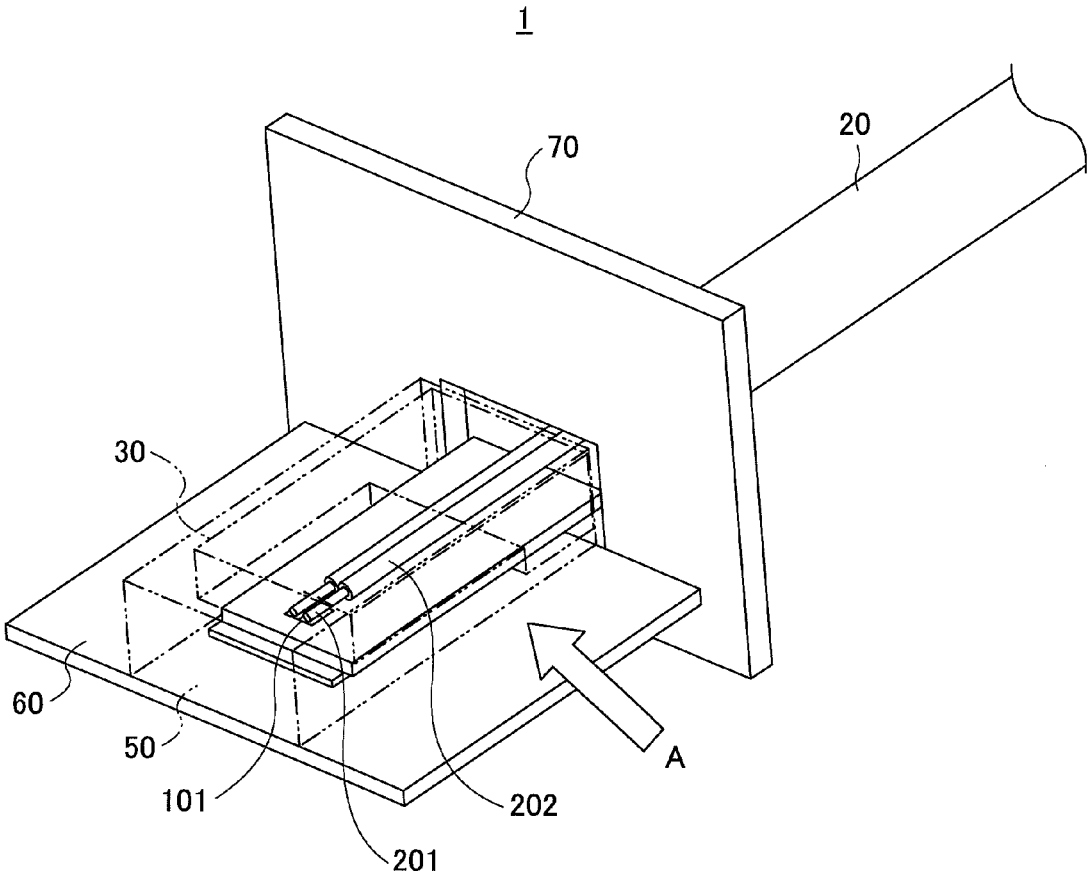
FIG. 2 is a schematic perspective view of the cable connector system after fitting.

The cable 20 is connected to the cable-side connector 10. The cable 20 may include one or more core wires 201. In FIG. 1 and FIG. 2, only one of the core wires 201 is illustrated for an easier understanding of the drawings.

The cable-side connector 10 is attached to the cable-side connector housing 30, which is illustrated as being transparent. The cable-side connector housing 30 is fitted to the board-side connector housing 50, which is illustrated as being transparent. The cable-side connector housing 30 is formed of, for example, molding resin or metal. The cable-side connector 10 is used in combination with the cable-side connector housing 30. For example, the cable-side connector 10, to which the cable 20 is connected, may be formed unitarily with the cable-side connector housing 30.

The board-side connector 40 is mounted on the circuit board 60 by way of being attached to the board-side connector housing 50. The cable-side connector housing 30 may be fitted to the board-side connector housing 50 in an opening of the enclosure 70. The board-side connector 40 is used in combination with the board-side connector housing 50. Like the cable-side connector 10, the board-side connector 40 may be formed unitarily with the board-side connector housing 50.

The cable-side connector 10 is fitted to and removed from the board-side connector 40. In FIG. 1, the direction in which the cable-side connector 10 is fitted to the board-side connector 40 is referred to as "fitting direction." The fitting direction is a direction to insert the cable-side connector housing 30 into the board-side connector housing 50.

Next, fitting of the cable-side connector housing 30 and the board-side connector housing 50 is described with reference to FIG. 2.

FIG. 2 is a partially-transparent perspective view of a cable connector system after fitting the cable-side connector housing to the board-side connector housing according to an embodiment. Referring to FIG. 2, the cable-side connector housing 30 is inserted in and fitted to the board-side connector housing 50. In this state, the cable-side connector housing 30 and the board-side connector housing 50 are fitted to each other to electrically connect the cable-side connector 10 and the board-side connector 40, so that a transmission path is formed between the cable 20 and the circuit board 60.

Next, the electrical connection of the cable-side connector 10 and the board-side connector 40 fitted to each other in the state of FIG. 2 is described with reference to FIG. 3.

Figure 3:
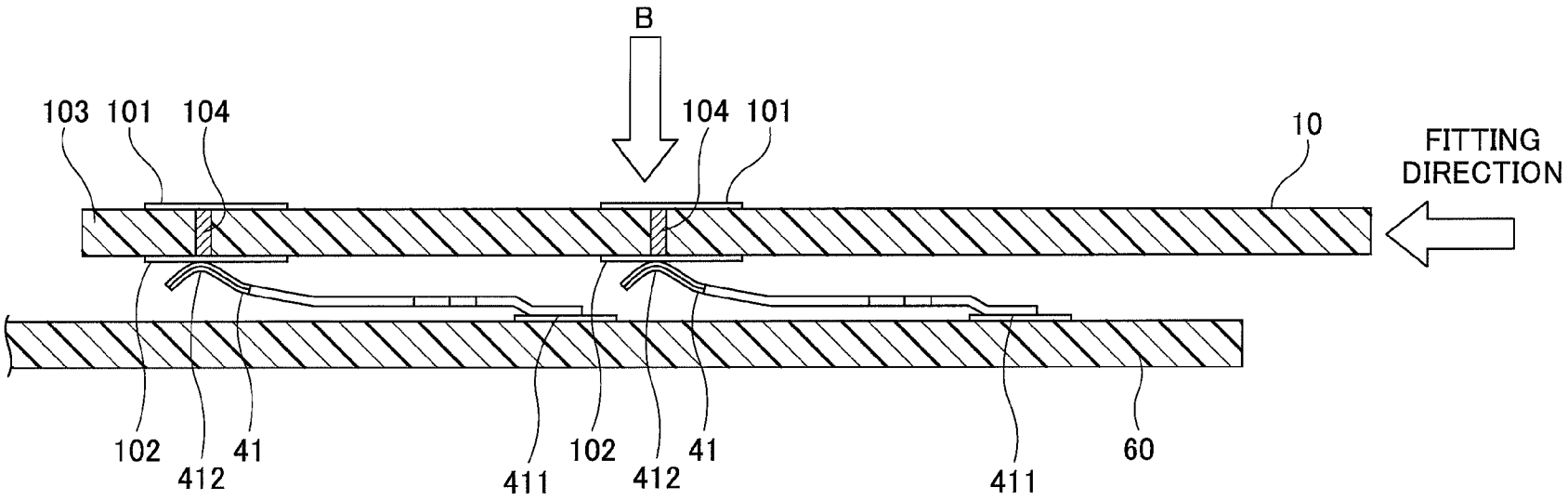
FIG. 3 is a side view of part of the cable connector system.
Figure 4:
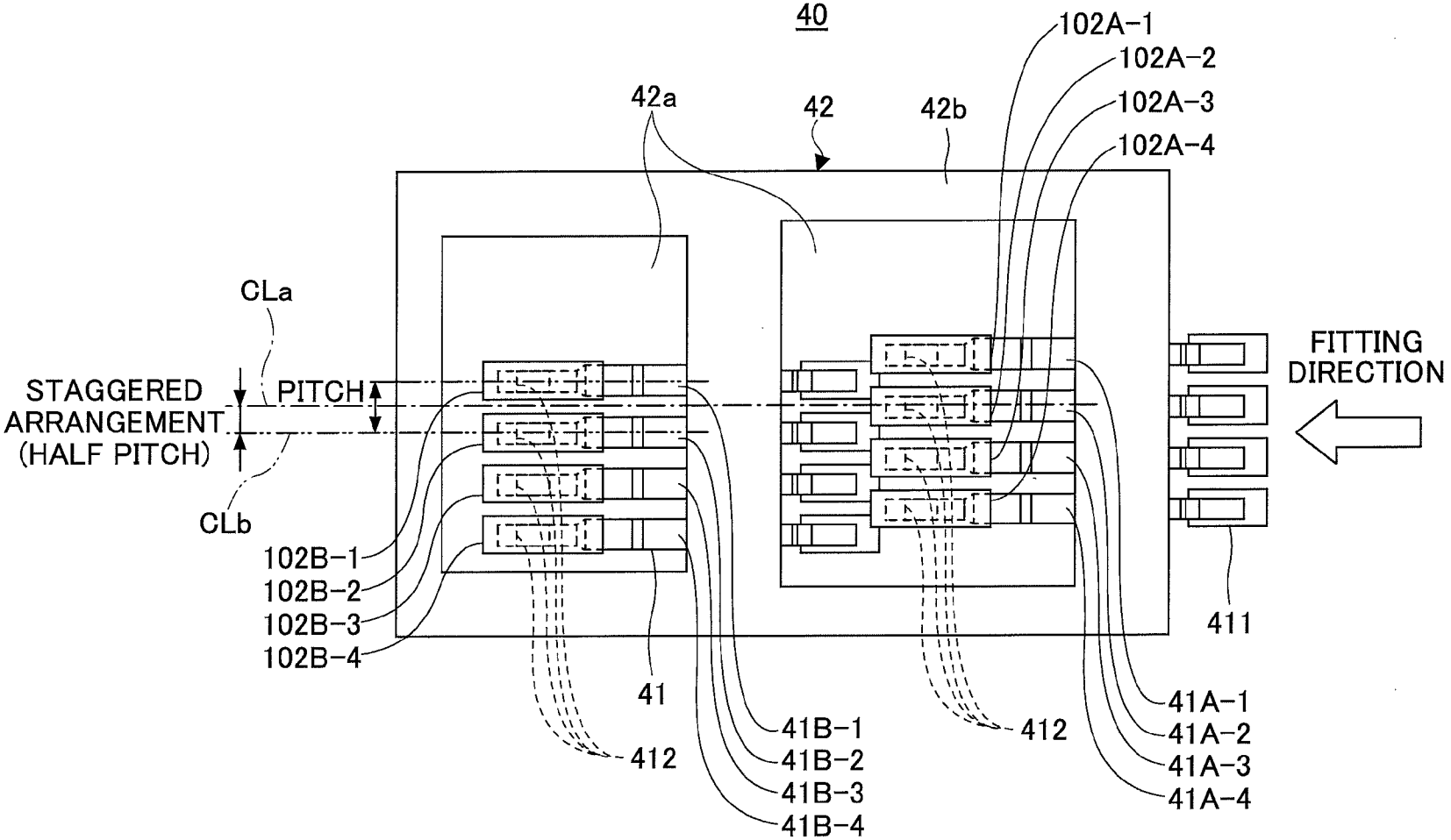
FIG. 4 is a plan view of part of the cable connector system.

FIG. 3 is a side view of the cable-side connector 10 and the board-side connector 40 in a direction indicated by an arrow A in FIG. 2. Referring to FIG. 3, the cable-side connector 10 includes cable pads 101, card edge contacts 102, a connector card 103, and electrically conducting parts 104. The board-side connector 40 includes jack contacts 41 and may further include a jack contact holding member 42 (FIG. 4). The board-side connector 40 is attached to a surface of the circuit board 60. In FIG. 3, the illustration of the jack contact holding member 42 is omitted and the connector card 103 and the circuit board 60 are illustrated in cross sections for convenience of description.

The cable pads 101 are electrically conductive members to which the cable 20 (FIG. 1) is connected. Each of the core wires 201 of the cable 20 is connected to one of the cable pads 101 by, for example, soldering, screwing, or pressing by a holding member. The cable pads 101 are attached to a first surface (top surface) of the connector card 103. Each of the cable pads 101 is electrically connected to one of the card edge contacts 102, attached to a second surface (bottom surface) of the connector card 103, by the electrically conductive part 104 provided through the connector card 103.

Each of the card edge contacts 102 is an electrically conductive member that comes into contact with one of the jack contacts 41 of the board-side connector 40. The surfaces of the card edge contacts 102 may be plated with, for example, gold or nickel. Referring to FIG. 3, the card edge contacts 102 are conductors formed on the second surface of the connector card 103, so that the card edge contacts 102 project from the second surface of the connector card 103 by the thickness of the conductors. Alternatively, for example, recesses may be formed on the second surface of the connector card 103, and the card edge contacts 102 may be provided in the recesses. According to this configuration, contact parts 412 of the jack contacts 41 enter the recesses, so as to make it possible to make the connector card 103 less likely to be pulled out in a direction opposite to the fitting direction with the resilient urging forces of the jack contacts 41.

The connector card 103 may employ a printed board using a material such as FR4, for example. Furthermore, electronic components such as capacitors, which are not illustrated in this embodiment, may be mounted on the connector card 103.

Each of the electrically conductive parts 104 is provided through the connector card 103 to electrically connect the cable pad 101 and the corresponding card edge contact 102. The cable pad 101 and the corresponding card edge contact 102 are disposed at positions opposite to each other across the connector card 103. The electrically conductive parts 104 connect the cable pads 101 and the card edge contacts 102 at a short distance from each other, which is substantially equal to the thickness of the connector card 103. Therefore, it is possible to connect the cable pads 101 and the card edge contacts 102 with low impedance.

With respect to the shape of the electrically conductive parts 104, the cross-sectional area of the electrically conductive parts 104 may be determined so that the impedance is sufficiently low with respect to the frequency of electrical signals transmitted between the cable 20 and the circuit board 60. Furthermore, the shape of the electrically conductive parts 104 may be determined in view of impedance matching with the cable 20. Accordingly, it is possible to keep the occurrence of noise or transmission loss low in the transmission path between the cable 20 and the circuit board 60.

The electrically conductive parts 104 may have the shape of a column or a quadrangular prism to penetrate through the connector card 103. Alternatively, the electrically conductive parts 104 may have the shape of a column that has a through hole formed in its center to penetrate through the connector card 103.

In this embodiment, the cable pads 101, the card edge contacts 102, and the electrically conductive parts 104 are described as functionally separate parts that are connected. Alternatively, the cable pads 101, the card edge contacts 102, and the electrically conductive parts 104 may be formed of a unitary member, for example.

The jack contacts 41 are electrically conductive spring members that electrically connect the card edge contacts 102 and the circuit board 60. Each of the jack contacts 41 includes a connecting part 411 and the contact part 412. The connecting parts 411 are connected to the circuit board 60 by, for example, soldering the connecting parts 411 to the surface of the circuit board 60. Examples of the material of the jack contacts 41 include electrically conductive metal plates having a spring characteristic, such as those of phosphor bronze, beryllium bronze, and stainless steel. The jack contacts 41 are formed by, for example, bending a metal leaf spring having a thickness of 0.08 mm to 0.15 mm into the shape illustrated in the drawings by press working. The jack contacts 41 are provided to rise from the surface of the circuit board 60 with the connecting parts 411 connected to the surface of the circuit board 60, so that the contact parts 412 come into contact with the card edge contacts 102. Furthermore, each of the jack contacts 41 may be plated entirely or partly with nickel, copper, or gold.

Like the connector card 103, the circuit board 60 may employ a printed board using a material such as FR4, for example. Electronic components, which are not illustrated in this embodiment, may be mounted on the circuit board 60.

The circuit board 60 processes electrical signals transmitted by the contact of the cable-side connector 10 and the board-side connector 40.

Next, the board-side connector 40, which is attached to the circuit board 60, is described in detail with reference to FIG. 4.

FIG. 4 is a plan view of the cable-side connector 10 and the board-side connector 40 in a direction indicated by an arrow B in FIG. 3. In FIG. 4, the illustration of the cable-side connector 10 except for the card edge contacts 102 is omitted for convenience of description.

Referring to FIG. 4, the jack contact holding member 42 presses the jack contacts 41. Openings 42*a* are formed in the jack contact holding member 42 in accordance with the positions of the contact parts 412 of the jack contacts 41. The jack contact holding member 42 includes a flat plate part 42*b* that surrounds the openings 42*a*. The connector card 103 (FIG. 3) may slide on the flat plate part 42*b* of the jack contact holding member 42 to bring the cable-side connector 10 into contact with the board-side connector 40. The jack contacts 41 are held by the jack contact holding member 42. By holding the jack contacts 41 with the jack contact holding member 42, the contact parts 412 of the jack contacts 41 may be aligned to project from the openings 42*a* of the jack contact holding member 42 at the same height (at the same vertical position in the upward direction of FIG. 3) when the cable-side connector 10 is not fitted to the board-side connector 40.

According to this embodiment, the jack contacts 41 are arranged in two rows, a front row and a back row, in the fitting direction of the cable-side connector 10. Here, the term "row" refers to a line in a vertical direction of FIG. 4 in which the contact parts 412 are arranged in each of the openings 42*a* of the jack contact holding member 42. Furthermore, in this embodiment, the term "front row" refers to the row which is closer to the opening of the enclosure 70 (FIG. 1). In FIG. 4, the jack contacts 41 in the front row are referred to by reference numerals 41A-1, 41A-2, 41A-3, and 41A-4, and the jack contacts 41 in the back row are referred to by reference numerals 41B-1, 41B-2, 41B-3, and 41B-4. Furthermore, the card edge contacts 102 that come into contact with the jack contacts 41A-1, 41A-2, 41A-3, and 41A-4 in a front row are referred to by reference numerals 102A-1, 102A-2, 102A-3, and 102A-4, respectively, and the card edge contacts 102 that come into contact with the jack contacts 41B-1, 41B-2, 41B-3, and 41B-4 in a back row are referred to by reference numerals 102B-1, 102B-2, 102B-3, and 102B-4, respectively.

The jack contacts 41 are arranged with the same pitch (at equal intervals) in each of the front row and the back row. That is, the adjacent jack contacts 41A-1 through 41A-4 in the front row are arranged with the same pitch, and the adjacent jack contacts 41B-1 through 41B-4 in the back row are arranged with the same pitch.

The jack contacts 41A-1 through 41A-4 in the front row and the jack contacts 41B-1 through 41B-4 in the back row are in a staggered arrangement with each other with an offset in a direction perpendicular to the fitting direction. Correspondingly, the card edge contacts 102A-1 through 102A-4 in the front row and the card edge contacts 102B-1 through 102B-4 in the back row are in the same staggered arrangement. Referring to FIG. 4, a center line CLa of the jack contact 41A-2 in the front row indicated by a one-dot chain line is offset by a half (½) pitch from a center line CLb of the jack contact 41B-2 in the back row indicated by a two-dot chain line. That is, the jack contacts 41 of the front row and the back row are in a staggered arrangement with an offset of a half pitch. Likewise, the center line CLa of the card edge contact 102A-2 in the front row is offset by a half (½) pitch from the center line CLb of the card edge contact 102B-2 in the back row. That is, the card edge contacts 102 of the front row and the back row are in a staggered arrangement with an offset of a half pitch. This offset between front and back rows in the staggered arrangement is not limited to a half pitch, and may be a ⅓ pitch or a ¼ pitch.

According to this embodiment, the width of the card edge contacts 102 in a direction perpendicular to the fitting direction may be smaller (narrower) than the pitch between adjacent contact parts 412. In this case, when the connector card 103 of the cable-side connector 10 slides on the jack contact holding member 42 of the board-side connector 40 in the fitting direction, the contact parts 412 of the jack contacts 41A-1 through 41A-4 in the front row do not come into contact with the card edge contacts 102B-1 through 102B-4 during the sliding of the connector card 103, and come into contact with the corresponding card edge contacts 102A-1 through 102A-4 when the cable-side connector 10 is inserted up to its fitting position. Therefore, no wrong contacts occur during the fitting of the cable-side connector 10 and the board-side connector 40.

Likewise, in the case of providing recesses on the second surface of the connector card 103 and providing the card edge contacts 102 in the recesses as well, it is possible to prevent the contact parts 412 of the jack contacts 41A-1 through 41A-4 in the front row from wrongly contacting the card edge contacts 102B-1 through 102B-4 during the fitting of the cable-side connector 10 and the board-side connector 40.

FIG. 4 illustrates the case where the jack contacts 41 are arranged in two rows, front and back, in the fitting direction. Alternatively, the jack contacts 41 may be arranged in two or more rows, for example, three rows. In this case, the jack contacts 41 of adjacent rows may be offset from each other with the same pitch or different pitches in the staggered arrangement.

Figure 5:
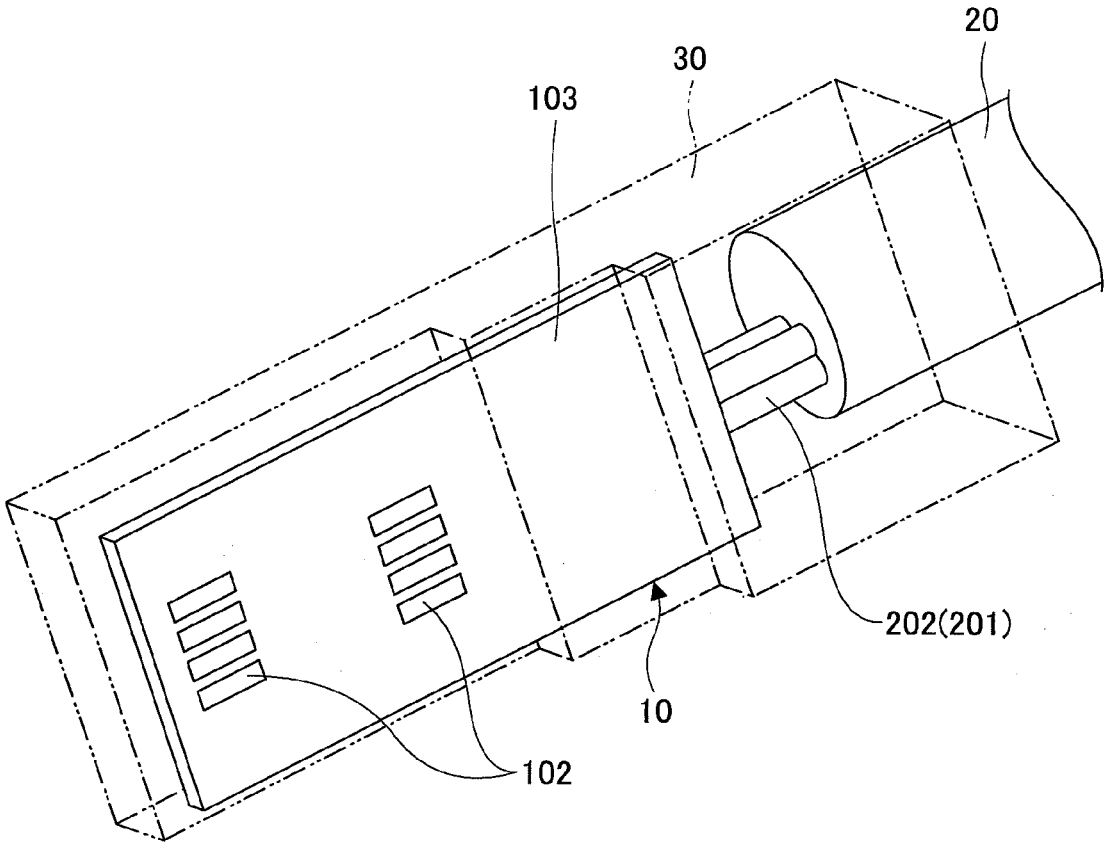
FIG. 5 is a perspective view of a cable-side connector.

FIG. 5 is a perspective view of the cable-side connector 10. FIG. 5 illustrates a case where the number of the card edge contacts 102 of the cable-side connector 10 is eight. The card edge contacts 102 are in the same staggered arrangement as the staggered arrangement of the jack contacts 41 illustrated in FIG. 4.

The connector card 103 and the cable 20 are attached and fixed to the cable-side connector housing 30. The cable-side connector housing 30 is formed of, for example, molding resin. The cable-side connector housing 30 may unitarily encapsulate the connector card 103 into a cable-side connector device. Each of the card edge contacts 102 is disposed on the second surface of the connector card 103 so as to come into contact with the corresponding jack contact 41. In FIG. 5, the illustration of some of the core wires 201, which are covered with respective jackets 202, is omitted.

Figure 6:
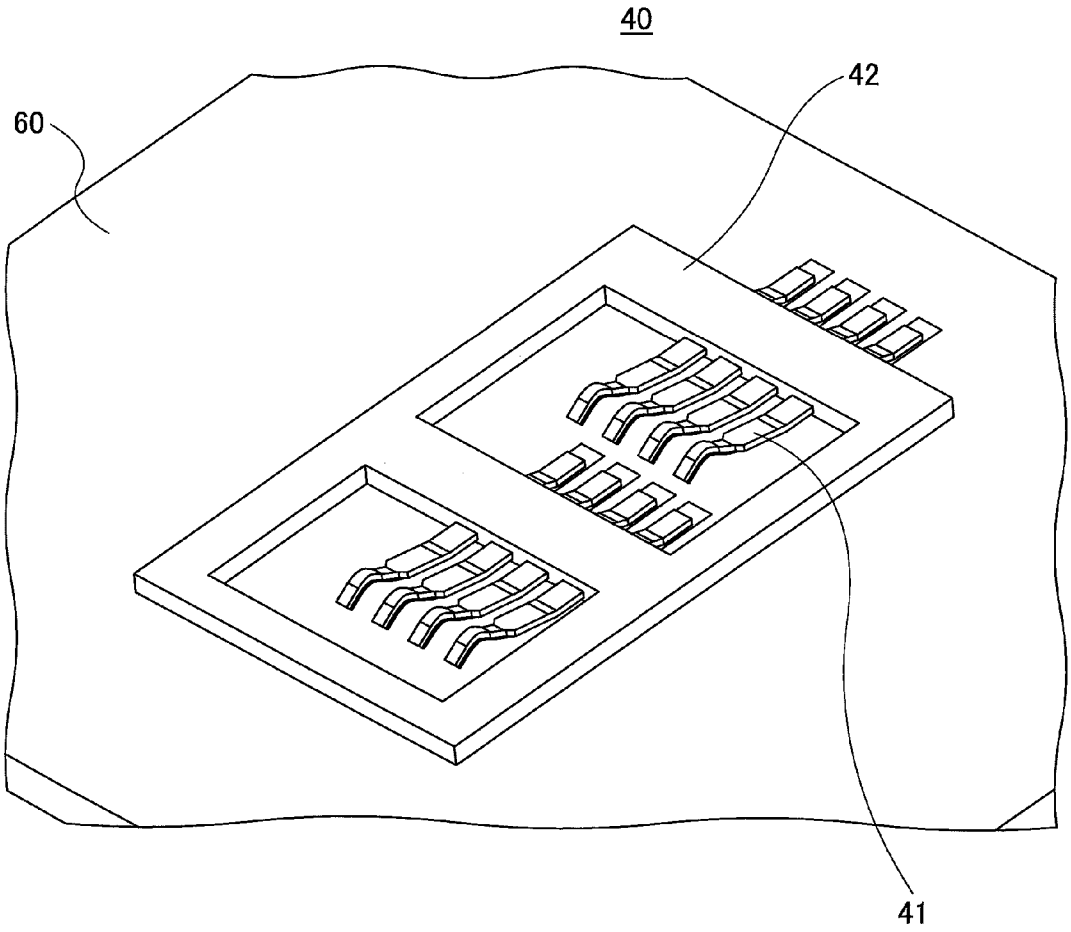
FIG. 6 is a perspective view of a board-side connector.

FIG. 6 is a perspective view of the board-side connector 40. Referring to FIG. 6, the jack contacts 41 are attached to the circuit board 60 with the jack contact holding member 42 holding the jack contacts 41. The jack contacts 41 and the jack contact holding member 42 may be formed unitarily into the board-side connector 40. For example, the jack contact holding member 42 may be formed of molding resin and hold the jack contacts 41 in such a manner as to cover the jack contacts 41. In the board-side connector 40 where the jack contacts 41 (41A-1 through 41A-4 and 41B-1 through 41B-2 in FIG. 4) are thus held by the jack contact holding member 42 so that the positions of the jack contacts 41 are fixed relative to each other in advance, it is easy to position the connecting parts 411 of the jack contacts 41 on the circuit board 60 when soldering the multiple jack contacts 41 (eight in FIG. 6) to the surface of the circuit board 60. FIG. 3 and FIG. 6 illustrate the case where the connecting parts 411 of the jack contacts 41 are directly soldered to the circuit board 60. Alternatively, the connecting parts 411 of the jack contacts 41 may be attached onto another board in advance, and the other board may be soldered to the circuit board 60 in a separate process.

Figure 7:
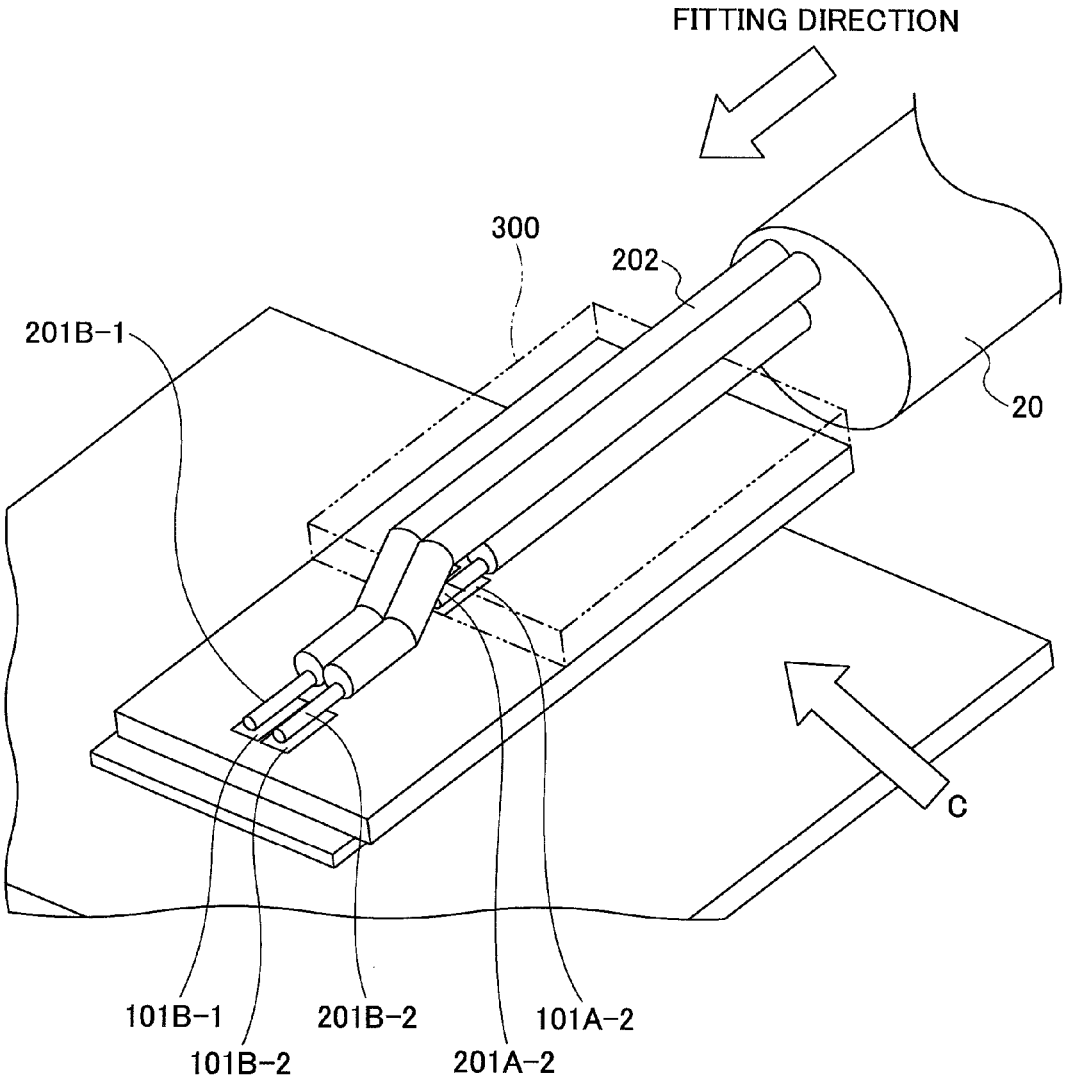
FIG. 7 is a perspective view illustrating the connection of a cable to a cable connector unit.

FIG. 7 is a perspective view illustrating the connection of the cable 20 to a cable connector unit. Here, the cable connector unit includes the cable-side connector 10 and the board-side connector 40. For simplification, FIG. 7 illustrates the case where the number of the core wires 201 of the cable 20 is four and the number of the cable pads 101 of the cable-side connector 10 is four. Referring to FIG. 7, a core wire 201A-2 and another core wire (not illustrated) of the cable 20 are soldered to a cable pad 101A-2 and another cable pad (not illustrated) in a front row, respectively, and a core wire 201B-1 and a core wire 201B-2 of the cable 20 are soldered to a cable pad 101B-1 and a cable pad 101B-2 in a back row, respectively.

Figure 8:
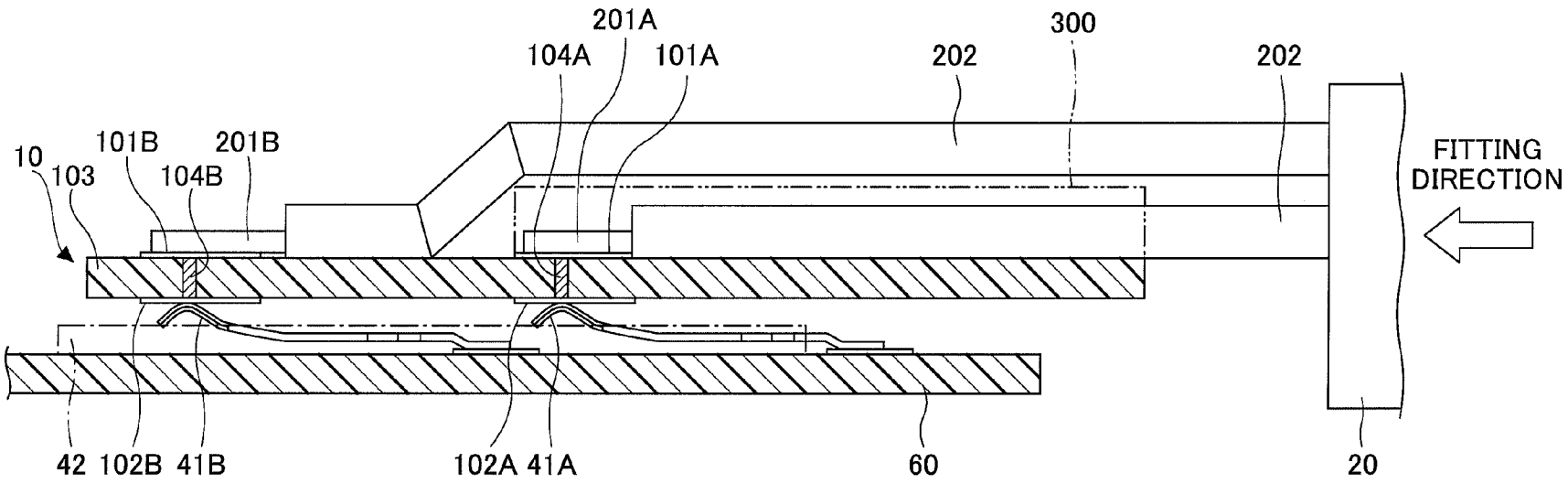
FIG. 8 is a side view of the cable and the cable connector unit.

FIG. 8 is a side view of the cable connector unit and the cable 20 in a direction indicated by an arrow C in FIG. 7. In FIG. 8, the connector card 103 and the circuit board 60 are illustrated in cross sections for convenience of description.

Referring to FIG. 8, cable pads 101A and cable pads 101B are arranged in a front row and a back row, respectively, on the first surface of the connector card 103. Core wires 201A and core wires 201B of the cable 20 are arranged one over another, that is, in two tiers, in a vertical direction. The core wires 201A and 201B extend to be arranged in a front row and a back row to be soldered to the cable pads 101A in the front row and the cable pads 101B in the back row, respectively.

The lower core wires 201A and their respective jackets 202 may be sealed with a sealing resin 300 indicated by a two-dot chain line as illustrated in FIG. 8. The upper core wires 201B and their respective jackets 202 may also be sealed with resin. Resin sealing makes it possible to stably fix the core wires 201A and 201B that are separated in two tiers in a vertical direction. In the case of forming the core wires 201 and the connector card 103 by resin sealing as illustrated in this embodiment, the cable-side connector 10 may include the cable 20.

The cable pads 101A and the cable pads 101B, to which the core wires 201A and the core wires 201B are directly soldered, respectively, are electrically connected to card edge contacts 102A and card edge contacts 102B by electrically conductive parts 104A and electrically conductive parts 104B provided through the connector card 103, respectively. According to this configuration, each of the core wires 201 of the cable 20 and the corresponding card edge contact 102 are electrically connected in a short distance. Therefore, according to the cable-side connector 10 of this embodiment, it is possible to reduce the occurrence of noise or transmission loss compared with, for example, the conventional cable-side connector described above, where electrically conductive parts are formed with conductive interconnection patterns on a printed circuit board.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A connector connectable to another connector, comprising:

a connector card including a first surface and a second surface;

a cable pad provided on the first surface, wherein the cable pad includes a flat surface that physically contacts a cable core wire, when the cable core wire is connected to the cable pad;

a contact that is provided on the second surface and corresponds to the cable pad, wherein the contact is positioned across the connector card from the corresponding cable pad, and includes a flat surface that physically contacts said another connector, when the connector is connected to said another connector; and an electrically conductive part provided through the connector card, wherein the conductive part electrically connects the cable pad and the corresponding contact, wherein a part of the flat surface of the cable pad positioned immediately above the electrically conductive part contacts the cable core wire when the cable core wire is connected to the cable pad, and a part of the flat surface of the contact positioned immediately below the electrically conductive part contacts a contact part of a jack contact of said another connector when the connector is connected to said another connector.

2. The connector as claimed in claim 1, wherein a plurality of cable pads including said cable pad is provided on the first surface, a plurality of contacts including said contact is provided on the second surface, wherein each of the contacts corresponds to one of the cable pads, and a plurality of conductive parts including said conductive part is provided in the connector card, wherein each of the conductive parts connects one of the cable pads and a corresponding one of the contacts.

3. The connector as claimed in claim 2, wherein the contacts are arranged in a plurality of rows in a direction in which the connector is to be connected to said another connector, and the rows are in a staggered arrangement.

4. The connector as claimed in claim 2, wherein the contacts are arranged in a plurality of rows in a direction in which the connector is to be connected to said another connector, and the contacts of a first row and the contacts of a second row adjacent to the first row are offset in a direction perpendicular to the direction in which the connector is to be connected to said another connector.

5. The connector as claimed in claim 2, further comprising:

a cable including the one or more cable core wires, wherein each of the cable core wires is connected to one of the cable pads.

6. A connector mounted on a circuit board and connectable to another connector, comprising:

a plurality of jack contacts connected to the circuit board, and configured to come into contact with corresponding contacts of said another connector; and a jack contact holding member that is formed of resin, and holds and presses a portion of each of the jack contacts toward the circuit board, wherein the plurality of jack contacts include a first row of jack contacts that are arranged in a first direction perpendicular to a second direction in which said another connector connects to the connector, and a second row of jack contacts that are arranged in the first direction, the first row and the second row being arranged in the second direction, positions of the jack contacts of the first row are offset from positions of the jack contacts of the second row in the first direction when viewed in the second direction, and a pitch of contact parts of the jack contacts of each of the first row and the second row is greater than a width of the corresponding contacts of said another connector, the contact parts contacting the corresponding contacts of said another connector when the connector connects to said another connector.

7. The connector as claimed in claim 6, wherein, when the connector is connected to said another connector, the jack contact holding member holds the portion of each of the jack contacts in accordance with an arrangement of the corresponding contacts provided on a surface of a connector card of said another connector.

8. A connector unit, comprising:

a first connector; and a second connector connectable to the first connector, wherein the first connector includes a connector card including a first surface and a second surface;

a cable pad provided on the first surface, wherein the cable pad includes a flat surface that physically contacts a cable core wire, when the cable core wire is connected to the cable pad;

a contact that is provided on the second surface and corresponds to the cable pad, wherein the contact is positioned across the connector card from the corresponding cable pad, and includes a flat surface that physically contacts the second connector; and an electrically conductive part provided through the connector card, wherein the conductive part electrically connects the cable pad and the corresponding contact, and wherein the second connector includes a jack contact configured to come into contact with the contact of the first connector; and a jack contact holding member that holds the jack contact in accordance with an arrangement of the contact provided on the second surface of the connector card of the first connector.

9. The connector as claimed in claim 6, wherein each of the jack contacts includes the contact part at a first end and a connecting part at a second end opposite to the first end, the connecting part being connected to the circuit board, and the jack contact holding member presses the portion of each of the jack contacts between the contact part and the connecting part.

10. The connector as claimed in claim 6, wherein each of the jack contacts includes the contact part at one end, the jack contact holding member includes a surface that faces a surface of said another connector on which the corresponding contacts are provided when the connector is connected to said another connector, and the contact part of each of the jack contacts projects from said surface of the jack contact holding member through an opening formed through the jack contact holding member.

11. The connector as claimed in claim 6, wherein each of the jack contacts includes the contact part at one end, the jack contact holding member includes a flat plate part through which an opening is formed, and the contact part of each of the jack contacts is positioned in the opening and surrounded by an internal edge of the flat plate part that defines the opening, when viewed in a direction perpendicular to a surface of the flat plate part facing away from the circuit board.

12. The connector as claimed in claim 1, wherein the cable pad has a rectangular shape elongated in a direction in which the cable core wire extends when the cable pad is connected to the cable core wire, when viewed in a direction perpendicular to the first surface.

13. The connector as claimed in claim 1, wherein the contact has a rectangular shape elongated in a direction to connect the connector to said another connector, when viewed in a direction perpendicular to the second surface.

* * * * *